United States Patent [19]

Krishnakumar et al.

[11] Patent Number: 4,785,949

[45] Date of Patent: Nov. 22, 1988

[54] BASE CONFIGURATION FOR AN INTERNALLY PRESSURIZED CONTAINER

[75] Inventors: Suppayan M. Krishnakumar, Nashua; Wayne N. Collette, Merrimack, both of N.H.; Bryan H. Miller, Florence, Ky.

[73] Assignee: Continental PET Technologies, Inc., Norwalk, Conn.

[21] Appl. No.: 131,467

[22] Filed: Dec. 11, 1987

[51] Int. Cl.[4] ..... B65D 1/02

[52] U.S. Cl. ..... 215/1 C

[58] Field of Search ..... 215/1 C

[56] References Cited

U.S. PATENT DOCUMENTS 3,598,270 8/1971 Adomaitis ..... 215/1 C
4,294,366 10/1981 Chang ..... 215/1 C

FOREIGN PATENT DOCUMENTS 2920122 11/1980 Fed. Rep. of Germany ..... 215/1 C
2031837 4/1980 United Kingdom ..... 215/1 C

*Primary Examiner*—William Price
*Attorney, Agent, or Firm*—Charles E. Brown; Paul Shapiro; Charles A. Brown

[57] ABSTRACT

This relates to the base configuration of a biaxially oriented blow molded thermoplastic resin container. It has been found that by assigning more space to the ribs between adjacent legs and feet, during the blow molding of a preform, there is proportionally less thinning of the material of the preform in accordance with the greater width of rib, thereby providing greater strength in the high stress area of the base structure with a resultant lesser failure due to stress cracking.

12 Claims, 1 Drawing Sheet

BASE CONFIGURATION FOR AN INTERNALLY PRESSURIZED CONTAINER

This invention relates in general to new and useful improvements in blow molded thermoplastic resin containers, and more particularly to the configuration of the base of such a container.

Over the years there have been produced containers, primarily bottles, with a base configuration which is primarily hemispherical but which has projecting therefrom a plurality of legs terminating in feet, the portions of the base configuration between the legs being in the form of ribs. Failure of such base configurations by stress crack development and rupture is a severe problem in the field. Stress cracks are initiated in the base when the applied stress exceeds a certain critical level. By keeping the applied stress below the critical level, stress crack initiation is suppressed and thus the rupture of the base is suppressed. In accordance with this invention, the base configuration is modified by maximizing the cross sectional area of the ribs which results in a lower applied stress.

This invention most particularly relates to a thermoplastic resin blow molded container used in packaging carbonated beverages. The functional requirements of such a base configuration are:

Internal pressure resistance
Drop impact resistance
Standing stability
Blow moldability
Light in weight Under internal pressure condition, the major portion of the internal load is carried by the ribs. To keep the maximum stress levels within limits, the cross sectional areas of the ribs have to be maximized and sharp transitions at the rib and foot junction are to be avoided. At the same time, the shape and size of the foot should be such that it is blow moldable. Considering the total bottom surface area that is available, the blow moldable foot shape and size, the required standing stability and the required level difference betwen the lowermost point of the base and that of the feet, it has been found that as opposed to the six legs and feet which have been provided in the past, the maximum number of feet is limited to five. By limiting the number of feet utilized, the area of the base configuration available for the ribs is greatly increased. Further, it has been found that by increasing the width of the ribs, the thickness of the ribs also automatically increases.

Most specifically, in accordance with this invention, it is proposed to provide a base configuration which includes a maximum of five legs and feet as opposed to the customary six legs and feet, and to maintain the outline of the legs and feet substantially the same as those of the base configuration which includes six legs and feet. Thus each leg has an angular extent of 72°. By making the angular extend of each leg on the leg of 40°, this leaves an angular extent on the order of 32° for each rib as opposed to the prior angular extend of the rib on the order of 20°.

With the above and other objects in view that will hereinafter appear, the nature of the invention will be more clearly understood by reference to the following detailed description, the appended claims, and the several views illustrated in the accompanying drawings.

Figure 1:
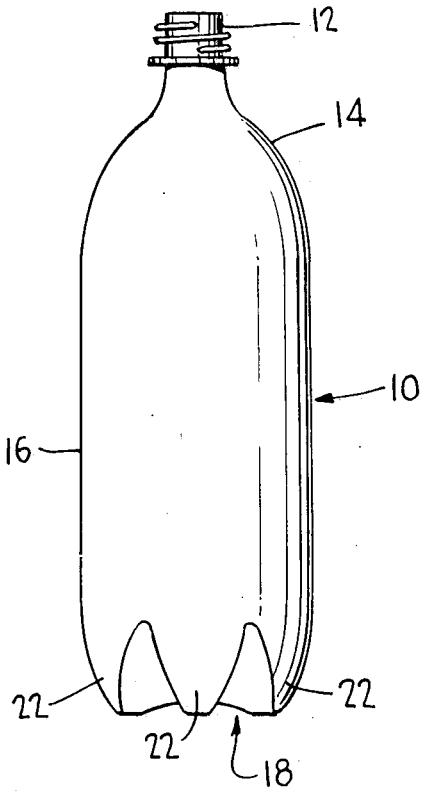
FIG. 1 is an elevational view of a bottle having a base configuration formed in accordance with this invention.

Referring now to the drawings in detail, it will be seen that there is illustrated in FIG. 1 a conventional type of bottle which is generally identified by the numeral 10. The bottle 10 is formed of a thermoplastic resin, such as PET, and is blow molded from a preform which includes an injection molded neck finish 12. The bottle 10 has a shoulder portion 14, a cylindrical body portion 16 and a base configuration 18. It is the base configuration which is the subject of this invention.

Figure 2:
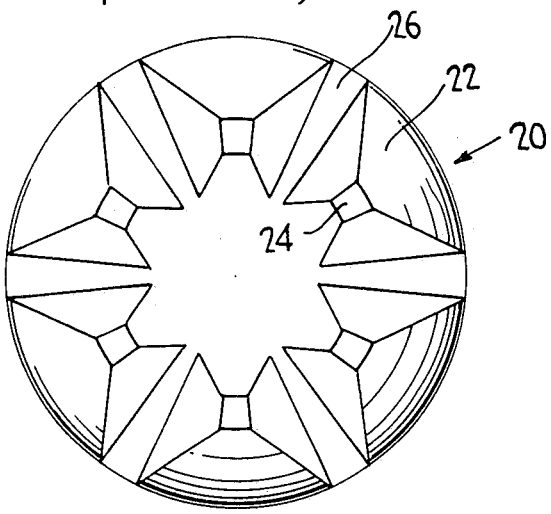
FIG. 2 (PRIOR ART)
FIG. 2 is an enlarged bottom plan view of a base configuration for a bottle such as that of FIG. 1 but wherein six legs are employed.

Reference is first made to the prior art base configuration showing of FIG. 2. It will be seen that the base configuration of FIG. 2, which is generally identified by the numeral 20, is of a circular outline and includes six projecting legs 22, each of which terminates in a lowermost foot 24. Between each pair of legs 22 there is disposed a rib 26. It is generally within this rib or its connection to an associated one of the legs 22 that stress cracks occur.

It has been found that a proper design of the leg 22 and its associated foot 24 requires a leg having an angular extent on the order of 40°. It will be obvious that if there are six of the legs 22, then the angular extend afforded each leg 22 and its associated rib 26 is 60°. This results in each rib 26 having an angular extent on the order of 20°.

In accordance with this invention, it has been found that if the ribs are constructed to have a greater angular extent, the ribs will maintain a greater thickness with the thickness of the ribs being proportional to the angular extent thereof. Having made this determination, in accordance with this invention, the ribs are made wider in the base configuration 18 as is clearly shown in FIG. 3.

Further, it has been determined that the configuration of the legs 22 and associated feet 24 meets the specific requirements of the base configuration. Therefore, in accordance with this invention, while the legs 22 and the feet 24 remain substantially identical in the base configurations 18, 20, the number of legs has been reduced at least by one. In order to provide the necessary rib strength, a maximum of five legs 22 is utilized. While it is feasible to utilize a lesser number of legs, such as four, it has been found that excellent stability results from the use of five legs whereas four legs frequently provide insufficient stability, particularly when the bottle is seated on a refrigerator rack.

Figure 3:
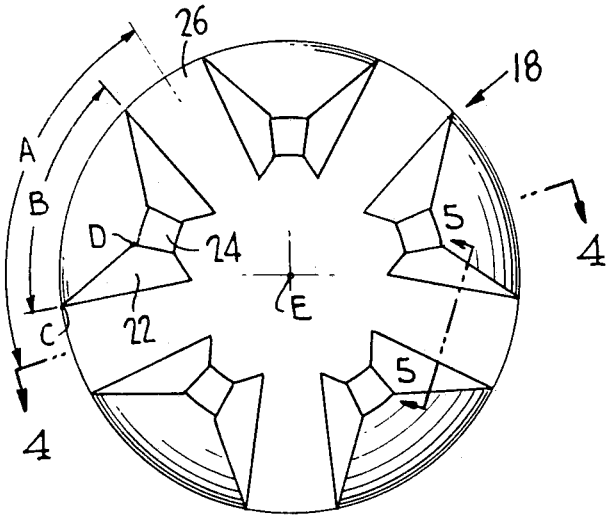
FIG. 3 is a bottom plan view of the base configuration of the bottle of FIG. 1 wherein only five legs are provided.

The utilization of five legs 22 as opposed to the conventional six legs provides unobvious results. With particular reference to FIG. 3, it will be seen that each of the spaces assigned to each leg 22 has an angular extent of A which in the case of five legs will be 72°. On the other hand, the leg per se will have an angular extent B only on the order of 40°. This leaves as much as 32° angular extent for rib 26.

Figure 5:
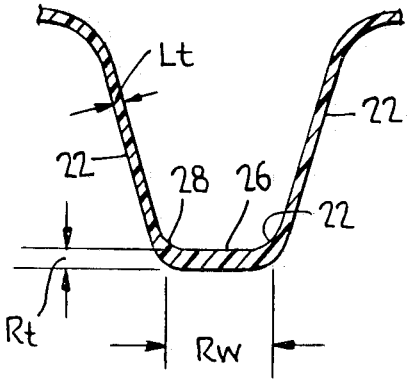
FIG. 5 is an enlarged fragmentary vertical sectional view taken generally along the line 5—5 of FIG. 3 and shows the specific configuration of one of the ribs.

It has been found that, with reference to FIG. 5, the greater width Rw of the rib 26, the greater the thickness Rt of the rib. Further, it will be seen that the thickness Rt of the rib 26 is materially greater than the thickness Lt of the associated leg 22. This increase in thickness of the rib 26 provides for greater strength in the base in the area of greater stress. Furthermore, as will be apparent from FIG. 5, in a fillet area 28 between each of the ribs 26 and the adjacent leg 22, there will be an increase in thickness. The net result is that the modified base configuration, generally identified by the numeral 18 shown in FIGS. 3–5 has a greater resistance to stress cracks.

At this time it is pointed out that while the intersection between each leg and an adjacent rib has been illustrated as being linear and radial, it may be slightly curved.

At this time it is also pointed out that the radial distance from the center E of the base configuration to a far corner D of a foot 24 is about 0.8 of the distance from the center E to the circular outline C of the base configuration.

Figure 4:
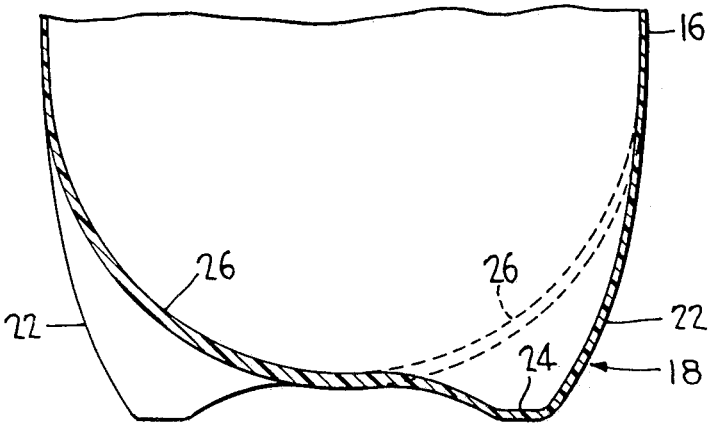
FIG. 4 is an enlarged fragmentary vertical sectional view taken generally along the line 4—4 of FIG. 3 and shows the cross section of the base configuration through one of the legs and a diametrically opposite rib.

Referring to FIG. 4, it will be seen that the ribs 26 are arcuate in longitudinal section and while they have been generally illustrated as being flat in FIG. 5, they may also have an arcuate transverse section so as to define portions of a hemisphere which would be the natural configuration of the base 18 if it were not for the special provision of the legs 22 and the feet 24.

Although only a preferred embodiment of the base configuration has been specifically illustrated and described herein, it is to be understood that minor variations may be made therein without departing from the spirit and scope of the invention as defined by the appended claims.

We claim:

1. A base configuration for an internally pressurized container, said base configuration being generally circular in outline and comprising a maximum of five radiating legs each terminating in a foot recessed radially inwardly of the circular outline of said base configuration, and said legs being separated by a radially extending rib, said base configuration being improved by said legs and feet being generally of the same outline of ribs and legs in a base configuration having six legs and feet and said ribs being of a greater width than like ribs in a base configuration having six legs and feet.

2. A base configuration according to claim 1 wherein each rib has a wall thickness proportional to the width of said rib.

3. A base configuration according to claim 1 wherein each rib has a wall thickness proportional to the width of said rib with the greater the rib width the greater the rib thickness.

4. A base configuration according to claim 1 wherein the angular extent of each rib is on the order of 30° and greater.

5. A base configuration according to claim 1 wherein said ribs have a configuration generally forming a portion of a hemisphere.

6. A base configuration according to claim 1 wherein said legs are five in number and the angular extent of each of said legs is $\geqq 40°$.

7. A base configuration according to claim 1 wherein said legs are five in number and the angular extent of each of said legs is on the order of 40° providing an angular extent of said rib on the order of 32°.

8. A base configuration according to claim 1 wherein each foot has radially outer corners and the spacing of each such corner from the center of said base being on the order of 80% of the diameter of said base configuration.

9. A base configuration for an internally pressurized container, said base configuration being generally circular in outline and comprising five radiating legs each terminating in a foot recessed radially inwardly of the circular outline of said base configuration and said legs being separated by a radially extending rib, said base configuration being improved by each rib having an angular extent on the order of 30°.

10. A base configuration according to claim 9 wherein said legs each have an angular extent on the order of 40° providing an angular extent of said ribs on the order of 32°.

11. A base configuration according to claim 9 wherein said ribs have a configuration generally forming a portion of a hemisphere.

12. A base configuration according to claim 9 wherein each foot has radially outer corners and the spacing of each such corner from the center of said base being on the order of 80% of the diameter of said base configuration.

* * * * *